US005413329A

United States Patent [19]

Hirsch

[11] Patent Number: 5,413,329

[45] Date of Patent: May 9, 1995

[54] GOLF CLUB ALIGNMENT GUIDE

[76] Inventor: Julian E. Hirsch, 21 Marlwood La., Palm Beach Gardens, Fla. 33418

[21] Appl. No.: 206,372

[22] Filed: Mar. 7, 1994

[51] Int. Cl.[6] ..... A63B 57/00

[52] U.S. Cl. ..... 273/32 B; 211/70.2

[58] Field of Search ..... 273/32 R, 32 B, 186.2, 273/162 R, 163 R, 194 R, 194 A, 194 B; 211/70.2

[56] References Cited

U.S. PATENT DOCUMENTS 2,753,189 7/1956 Conroy et al. ..... 211/70.2 X
4,216,831 8/1980 Ritchie ..... 273/32 B X
5,230,507 7/1993 White et al. ..... 211/70.2 X

*Primary Examiner*—George J. Marlo
*Attorney, Agent, or Firm*—Norman Friedland

[57] ABSTRACT

A detachable stand for supporting a golf club in situ includes a triangular shaped bracket member pivotally supporting a spring clamp adapted to clamp the shaft of the golf club at a location that will support the club in an upright position. The spring clamp allows the player to select the angle of the shaft relative to the player's stance. Once the club is in the upright position and aligned by the player while standing over the ball the stand allows the player to release the club and walk away to observe the selected alignment from different positions.

9 Claims, 1 Drawing Sheet

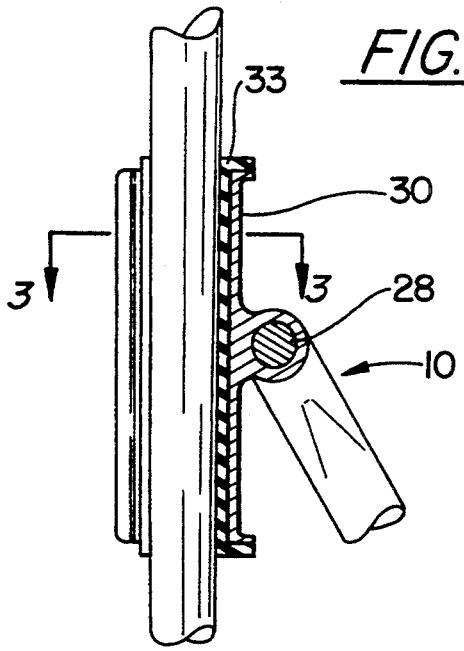
FIG. 2
FIG. 3
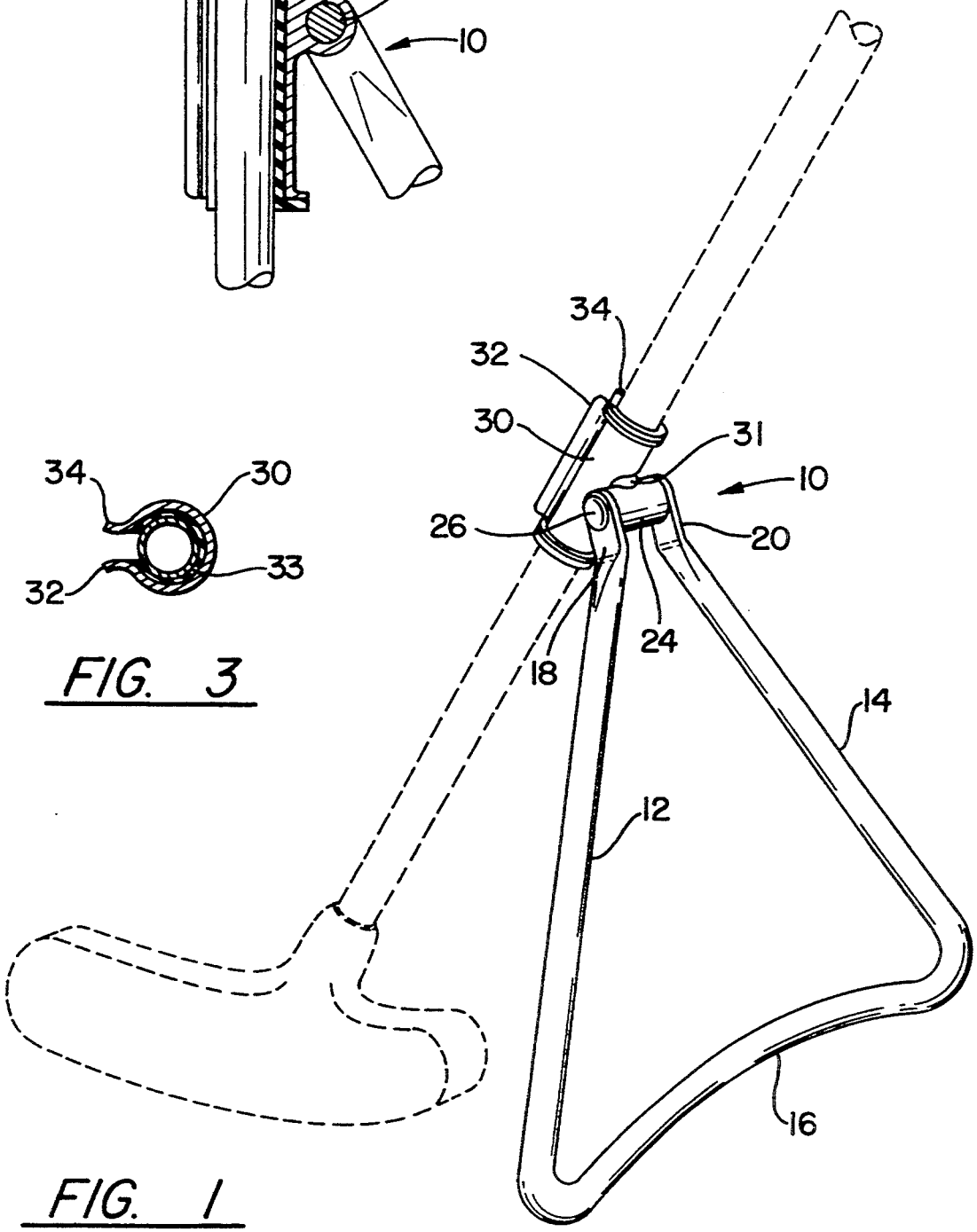
FIG. 1

GOLF CLUB ALIGNMENT GUIDE

TECHNICAL FIELD

This invention relates to a teaching tool for perfecting the alignment skills in the game of golf and particularly to a detachable stand for supporting a putter in situ to allow the player to walk behind the putter to determine whether the alignment is the same as perceived when the player stands over the putter in the hitting position prior to executing the putting stroke.

BACKGROUND ART

As one skilled in the game of golf will appreciate, the alignment of the club and ball relative to the ball's destination is important and in many instances critical. One typically sights the destination and ball by first standing behind the ball and then addressing the ball with a particular club and again sighting the alignment while standing over the ball. In putting, one is apt to take more precautions in getting the line-of-sight by not only taking a sighting from behind the ball, but will also look from different angles and positions to obtain, in the parlance of golf the "lay of the green". Indeed, one is apt to make a precision sighting, as perhaps, the putting is the most crucial stroke in the entire repertoire in the game of golf.

There is a commercially available putter that is capable of standing upright on its own, which allows the user to walk behind it to obtain a sighting. The problem with this putter is that it is "the" putter and is built to stand erect. Hence, this particular putter may not be the putter that is the preference of the player. Also the putter stands in an erect position and is stroked from the same position that the putter assumes. This putter does not take into account the particular angle that the shaft bears relative to the player. The angle of the shaft relative to the head of the club is typically selected for a particular player and is dictated by the upright position of the putter, the players height and stance. Obviously, since the angle of the stand alone putter is dictated by the parameters that require it to stand alone, this angle may not be the best angle that is suited for the player.

In my putter guide and accordance to this invention, a detachable stand is utilized and is independent of the player's putter. In other words, the stand can be utilized with any putter and is removable to allow the player to putt with the putter of his preference. The stand is simple to use, light in weight, easy to carry and does not impose a burden on the player, in the event the player wishes to use it during the game of play. However, the stand lends itself for practicing putting and for some it can be used merely as a teaching tool.

This invention contemplates a simple bracket having means on the bottom to brace the putter when mounted in situ. A spring clip on the upper end clips onto the shaft of the putter at some distance from the head. The spring clip is pivotable so that the bracket and the putter itself in situ are self standing and the putter will be at the angle selected by the player. In other words, the putter will remain in the upright position at the particular angle selected by the player to allow the player to walk behind the putter to observe the alignment relative to its destination namely, the hole in the putting surface.

SUMMARY OF THE INVENTION

An object of this invention is to provide an improved teaching tool for the game of golf designed to improve the alignment of the golf club relative to the ball's selected destination and particularly to a putter to improve the alignment of the putter relative to the hole that golf ball is aimed to enter.

A feature of this invention is a detachable stand to hold the putter in a desired upright position that includes a bracket with a base and a pivotal spring clamp. The invention is characterized as being relatively simple to use, inexpensive, light in weight and not cumbersome to hand carry.

The foregoing and other features of the present invention will become more apparent from the following description and accompanying drawings.

BRIEF DESCRIPTION OF THE DRAWINGS

FIG. 1 is a perspective and phantom view of this invention;

FIG. 2 is a partial view partly in section illustrating the pivotal spring clamp of this invention; and FIG. 3 is a sectional view taken along lines 3—3 of FIG. 2.

BEST MODE FOR CARRYING OUT THE INVENTION

The detachable golf club stand generally illustrated in FIGS. 1–3 shows the invention being utilized with a putter but as one skilled in this art will appreciate the stand can be utilized with any other club although putting is perhaps the portion of the game where this invention has the most utility. As shown, the preferred embodiment of this invention comprises a two legged bracket including upstanding legs 12 and 14 and a bottom cross support member 16 formed from a single tubular mender fabricated from suitable rigid material such as commercially available aluminum tubes. The legs are angled so that they are wider at the bottom and narrower at the top, defining a quasi-triangle. Cross support member 16 is bent inwardly (although it may alternatively be bent outwardly) relative to the plane formed by the upstanding legs 12 and 14 to afford support to hold the club when mounted to the stand 10 in the upright position. The cross support 16 may also be fabricated into a separate element that is pivotally attached to the bottom end of each of the legs. This would allow the stand to be folded into a relatively flat assembly which would facilitate carrying and storing the assembly.

The ends 18 and 20 of the upstanding legs 12 and 14 terminate at the upper end to define an opened space to receive the stub shaft 24 that is laterally supported thereto. Shaft 24 may include trunnions 26 formed on either end (one being shown) that fit into complementary apertures 28 formed on the ends 18 and 20 of legs 12 and 14, respectively and may include a head portion that is swaged or flattened to extend beyond the edge of the apertures to pivotally support the shaft 24 in place. The pivot joint is preferably of the type that will have sufficient frictional engagement so as to hold the set angle of the uprights 12 and 14 relative to angular position of shaft 24.

Spring clamp 30 formed from a single metallic flexible and resilient material is C-shaped and opened at the end opposite the point where it is attached to shaft 24. Spring clamp 30 may be suitably and rigidly attached to shaft 24, say by welding or braising as shown by weldment 31, and rotates therewith. Tangs 32 and 34 formed on the outer edges of spring clamp 30 serve as a guide to admit the shaft of the putter 36 shown in phantom in the C-shaped clamp. A suitable insert or liner 33 may be utilized to line the inner diameter of the C-shaped clamp which may be fabricated from a suitable rubber, elastomeric or synthetic material may be glued to the inner face of spring clamp 30. The liner forms a soft and resilient surface to securely hold the club's shaft and assure that the shaft will not be marred by the spring clamp. The spring force of the C-shaped spring clamp 30 is selected to assure that the shaft of the club is tightly secured and won't rotate when inserted in position, but yet will allow the rotation thereof by firmly gripping the club and stand and rotating one relative to the other.

Operation

In operation the shaft of the golf club, and assuming that a putter is used for the sake of this description, is snapped into the spring clamp of the detachable stand at a judicious location where the end of the putter head will rest on the ground and the stand will hold it in the upright position. The pivotal spring clamp is rotated, if need be, so the shaft of the putter relative to the ground is at the angle selected by the player. Once these parameters are selected the putter and stand is capable of supporting the putter in place and the player can stand over the putter and make his alignment. Adjustments to the putter can be made by rotating the putter's shaft while holding on to the stand to assure that the putter is square with the golf ball. The player also has the option of spreading the spring clamp open by use of tangs 32 and 34 to loosen the hold on the shaft. The player may also slide the putter shaft up or down relative to the stand by the same method described immediately above. Once the putter is set and standing in the upright position and the player has aligned the club while standing over the golf ball and club, the player can then walk away from the putter and observe whether the selected alignment of the putter relative to the hole is consistent with lines of sight taken from different angles sighted away from the golf ball and putter. This procedure can be repeated as many times as necessary until the player is satisfied with the alignment. The player then can either remove the stand from or leave the stand on the putter and stroke the ball. It is anticipated that by continuing the alignment by use of this stand and this method will ultimately improve the alignment capabilities of the player.

Although this invention has been shown and described with respect to detailed embodiments thereof, it will be appreciated and understood by those skilled in the art that various changes in form and detail thereof may be made without departing from the spirit and scope of the claimed invention.

I claim:

1. A detachable stand for supporting a golf club in situ comprising a generally truncated triangular shaped bracket formed from an elongated member having a pair of upstanding leg portions and a laterally extending base portion, clamp means rotatably supported to the end of each of said leg portions and being parallelly spaced relative to a plane through said base portion, said clamp means having a C-shaped flexible and resilient portion adapted to receive the shaft of the golf club through the opening formed by the C-shaped portion for encircling a portion of said shaft for clamping said shaft whereby said detachable stand and golf club when in the assembled position is self supporting to stand upright on the ground.

2. A detachable stand for supporting a golf club in situ as claimed in claim 1 wherein said elongated member is fabricated from a tubular member.

3. A detachable stand for supporting a golf club in situ as claimed in claim 1 including a stub shaft laterally extending between said pair of upstanding leg portions and pivotally attached to the end of each of said pair of upstanding leg portions remote from said base portion and said C-shaped flexible and resilient portion being attached to said stub shaft to rotate therewith.

4. A detachable stand for supporting a golf club in situ as claimed in claim 3 including a liner attached to the inner diameter of said C-shaped flexible and resilient portion.

5. A golf club detachable stand including a bracket having a pair of angularly disposed elongated upright legs being spaced further apart at the base and narrower at the upper end, the base portion extending laterally between the elongated legs and being parallel to the ground to rest thereon when in use, a rotatable shaft extending laterally to said legs and pivotally attached at the upper end of each leg and lying in a plane that is substantially parallel to a plane passing through said base portion, a C-shaped spring clamp attached to said rotatable shaft having the open portion of the C of the C-shaped clamp facing away from said detachable stand adapted to receive the shaft of a golf club, whereby said golf club and said detachable stand in situ are self supporting in the upright position relative to the ground when resting on the ground and the shaft is capable of being rotated along its longitudinal axis and relative to the ground when assembled in the spring clamp.

6. A golf club detachable stand as claimed in claim 5 wherein said base portion is arcuate in shape and parallel to the ground.

7. A golf club detachable stand as claimed in claim 6 including a liner attached to the inner diameter of said C-shaped clamp.

8. A golf club detachable stand as claimed in claim 7 including tang portions attached to the edges of the C-shaped clamp.

9. A detachable stand for supporting a golf club in situ in the upright position comprising bracket means having a base portion for resting on the ground, clamp means having an open end pivotally attached to one end of said bracket means remote from said base portion and being flexible and resilient to removably receive the shaft of the golf club through said open end for partially encircling a portion of said shaft for clamping said shaft whereby said detachable stand and golf club when in the assembled position is self supporting to stand upright on the ground.

* * * * *